US007289641B2

(12) United States Patent
Yang

(10) Patent No.: US 7,289,641 B2
(45) Date of Patent: Oct. 30, 2007

(54) MULTIPLE CHANNEL EARPHONE

(75) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 236 days.

(21) Appl. No.: 10/907,047

(22) Filed: Mar. 17, 2005

(65) Prior Publication Data

US 2005/0207607 A1 Sep. 22, 2005

(30) Foreign Application Priority Data

Mar. 22, 2004 (TW) ..... 93107621 A
Apr. 29, 2004 (TW) ..... 93111985 A
Feb. 4, 2005 (TW) ..... 94103553 A

(51) Int. Cl.
*H04R 25/00* (2006.01)

(52) U.S. Cl. ..... 381/382; 381/309; 381/371

(58) Field of Classification Search ..... 381/300, 381/307, 309, 335, 336, 338, 371, 372, 373, 381/376, 370, 382; 2/209; 181/129
See application file for complete search history.

(56) References Cited

U.S. PATENT DOCUMENTS 3,943,304 A * 3/1976 Piribauer ..... 381/99
7,155,025 B1 * 12/2006 Weffer ..... 381/370

FOREIGN PATENT DOCUMENTS

| | | | |
|---|---|---|---|
| CA | 2432832 | A1 | 12/2004 |
| WO | WO 2004/112423 | A2 | 12/2004 |
| WO | WO 2004/112423 | A3 | 12/2004 |

* cited by examiner

*Primary Examiner*—Huyen Le
(74) *Attorney, Agent, or Firm*—Jianq Chyun IP Office

(57) ABSTRACT

A multiple channel earphone is provided with an external tube disposed on the earphone main body. The earphone includes a case, a case extension unit, and a cover. A main sound field is formed in an interior chamber enclosed by the case, the case extension unit and the cover. By adjusting the space in the external tube, the spatial effect of the sound field is significantly increased. The proposed multiple channel earphone selectively has a mechanism for sound field balancing by the sounds generated from these two sub-speakers spaced apart from each other for better sound quality. The sound field of the proposed multiple channel earphone can also be spaced apart into two physically separated sound fields by disposing an external chamber on the earphone main body.

25 Claims, 10 Drawing Sheets

MULTIPLE CHANNEL EARPHONE

CROSS-REFERENCE TO RELATED APPLICATION

This application claims the priority benefit of Taiwan applications serial no. 93107621, filed on Mar. 22, 2004, serial no. 93111985, filed on Apr. 29, 2004, and serial no. 94103553, filed on Feb. 4, 2005. This application is a continuation-in-part of a prior application Ser. No. 10/709,956, filed Jun. 9, 2004. All disclosures are incorporated herewith.

BACKGROUND OF THE INVENTION

1. Field of the Invention

The present invention relates to a multiple channel earphone, and more particularly, to a multiple channel earphone having an extended sound field.

2. Description of the Related Art

Along with continuous progress of digital technology, the entertainment of the ordinary people had been gradually digitalized. For example, the DVD (Digital Video Disc, also known as Digital Versatile Disc) player is very popular in many households nowadays. Since DVD player has basically provided decoding functions such as Dolby Digital or Digital Theater System (DTS), it is capable of decoding digital signals and outputting analog signals to the speakers.

The multiple channel speaker is an inevitable device for enjoying the high quality digital AV entertainment program, and the 5.1 channel speaker is a fundamental component of the multiple channel speaker.

FIG. 1 schematically shows a diagram of a home theater with a 5.1 channel speaker. Referring to FIG. 1, when the DVD player 100 is playing an AV program, the DVD player 100 provides different audio signals to a front left speaker 102*a* and a front right speaker 102*b*, a center speaker 104, a left surround speaker 106*a* and a right surround speaker 106*b*, and a subwoofer 108, so as to create a 3D spatial sound effect for providing a realistic setting for the listener.

However, it is required to use an earphone to listen music under the circumstance of not suitable for using the speaker (for example, using speaker may disturb others). Referring to FIG. 2A, since a typical earphone 200*a* only has one speaker 210 in its both sides, respectively, it is not possible for the listener to enjoy the multiple channel sound effect provided by the DVD player.

Therefore, an earphone having a plurality of speakers in its main body had been proposed in the prior art. The conventional earphone 200*b* has a main channel speaker 202, a center speaker 204, and a surround speaker 206 in its both sides, respectively. By cooperated with a special design plug 208, the DVD player provides different channel's audio signal to different speaker through the plug 208, so as to further create the spatial sound effect of the 5.1 channel speaker in home theater environment. Since the delaying output of the audio signal is controlled in a digital way (e.g. with a circuit design) in the conventional earphone 200*b*, the spatial sound effect provided by it is not so good. It is far behind when compared with the spatial sound effect provided by the 5.1 channel speaker in home theater environment as shown in FIG. 1, and it cannot present the quality and function of the multiple channel surrounding sound effect.

SUMMARY OF THE INVENTION

Therefore, it is an object of the present invention to provide a multiple channel earphone. The multiple channel earphone improves the quality of the sound effect, and provides a saturated sound filed as well as a multiple channel surrounding sound effect.

The multiple channel earphone provided by the present invention comprises an external chamber tube or an external tube disposed on the earphone main body. The case and the cover of the earphone togetherly form an interior chamber, and the spatial sound effect is improved by adjusting the space in the external tube.

Besides the earphone having an external chamber tube or an external tube mentioned above, an earphone having an effect of balance sound field is further provided. The earphone with a balance sound effect couples any one of the sound sources provided by the 5.1 channel sound sources from the DVD player to two or more than two speakers at the same time, and these two speakers, one is disposed on a speaker holder in the interior chamber and the other one is disposed in the external tube. In other words, at least one speaker is disposed inside the case of the earphone, and one or more than one speaker is disposed on the external tube coupled to the main body. With such arrangement, a sound field is formed by these two or more than two speakers, which are coupled to a same sound source, based on the difference of the sounding point and the angle or physical location of the speakers, such that the sound field formed by this sound signal is enlarged and more saturated. These two or more than two speakers may be coupled to the sound signal either in parallel or in serial. Alternatively, a different level sound field can be formed by disposing these two or more than two speakers on different locations and with different angles.

Besides the earphone having an external chamber tube mentioned above, an earphone having a function of dividing the sound field is further provided. In this earphone, a tube is externally coupled to the earphone main body, and an interior chamber is formed on the outermost edge of the external tube. In addition, any one of the signal entities provided by the 5.1 channel sound sources from the DVD player is disposed in any direction or angle with respect to the case of the interior chamber, such that a resonance is formed inside the interior chamber.

In another embodiment of the present invention, a tube is further coupled on the case of the interior chamber, such that the resonance is not directly created in the interior chamber. Accordingly, the sound source on the case of the interior chamber provided by the 5.1 channel of the DVD player is pulled away from the main sound field formed by the 5.1 channel. In other words, in the earphone of the present embodiment, a resonant chamber is formed by the case of the main body, and the sound wave inside the resonant chamber is transmitted to the main sound field inside the case with air media through the external tube.

In order to achieve the objects mentioned above, an earphone is provided by the present invention. The earphone comprises an earphone main body, a main speaker, a plurality of sub-speakers, and a first external tube. Wherein, the earphone main body comprises a case, a cover, and a case extension unit, which togetherly form a main chamber. The main speaker and some sub-speakers are disposed inside the case. The first external tube is disposed on the earphone main body, and the effect of the sound field formed in the earphone is adjusted by adjusting the space in the first external tube. The first external tube may be disposed on the case extension unit or on the case of the earphone main body.

In the earphone mentioned above, one of the sub-speakers may be optionally disposed on the first external tube.

In the earphone mentioned above, the space in the first external tube is adjusted by making good use of the adjustable length and foldable characteristics of the first external tube.

In the earphone mentioned above, a second external tube may be further comprised and disposed on the earphone main body, so as to further adjust the characteristic of the sound field formed in the earphone. The space in the second external tube is adjusted by making good use of the adjustable length and foldable characteristics of the second external tube.

In the earphone mentioned above, wherein two or more than two sub-speakers are coupled to a same sound source, and they can be selectively disposed in the earphone main body or disposed on the first external tube externally coupled to the earphone main body. The sub-speakers are either serially or parallelly coupled to a same sound source.

In the earphone mentioned above, a tube and an interior chamber are further comprised. Wherein, the tube is coupled to the earphone main body. The interior chamber is disposed on the outermost edge of the tube for forming a resonant chamber inside the interior chamber, and the sound wave inside the resonant chamber is transmitted to the sound field inside the case with air media through the tube.

In the earphone mentioned above, a curve tube is further comprised. The curve tube is coupled on the case of the interior chamber for adjusting the resonant chamber, and the angle of the curve tube is 10~180 degrees. In an embodiment of the present invention, a sub-speaker may be disposed on the outer edge of the curve tube.

In order to achieve the objects mentioned above, an earphone is provided by the present invention. The earphone comprises an earphone main body, a main speaker, and a plurality of sub-speakers. Wherein, the earphone main body comprises a case, a cover, and a case extension unit, which togetherly form a main chamber. The main speaker and the sub-speakers are disposed inside the case, and two of the sub-speakers are coupled to a same sound source, such that the earphone can provide balance sound field.

In order to achieve the objects mentioned above, an earphone is provided by the present invention. The earphone comprises an earphone main body, a main speaker, a plurality of sub-speakers, a tube, and an interior chamber. Wherein, the earphone main body comprises a case, a cover, and a case extension unit, which togetherly form a main chamber. The main speaker and some sub-speakers are disposed inside the case. The tube is coupled on the earphone main body, and an interior chamber is on the outermost edge of the tube. A resonant chamber is formed inside the interior chamber, and the sound wave inside the resonant chamber is transmitted to the sound field inside the earphone main body with air media through the tube. Accordingly, the earphone can provide a function of dividing the sound field.

The earphone mentioned above further comprises a curve tube. The curve tube is coupled on the case of the interior chamber for adjusting the resonant chamber, and the angle of the curve tube is 10~180 degrees. In addition, one of the sub-speakers may be disposed on the outer edge of the curve tube.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE PREFERRED EMBODIMENTS

Figure 1:
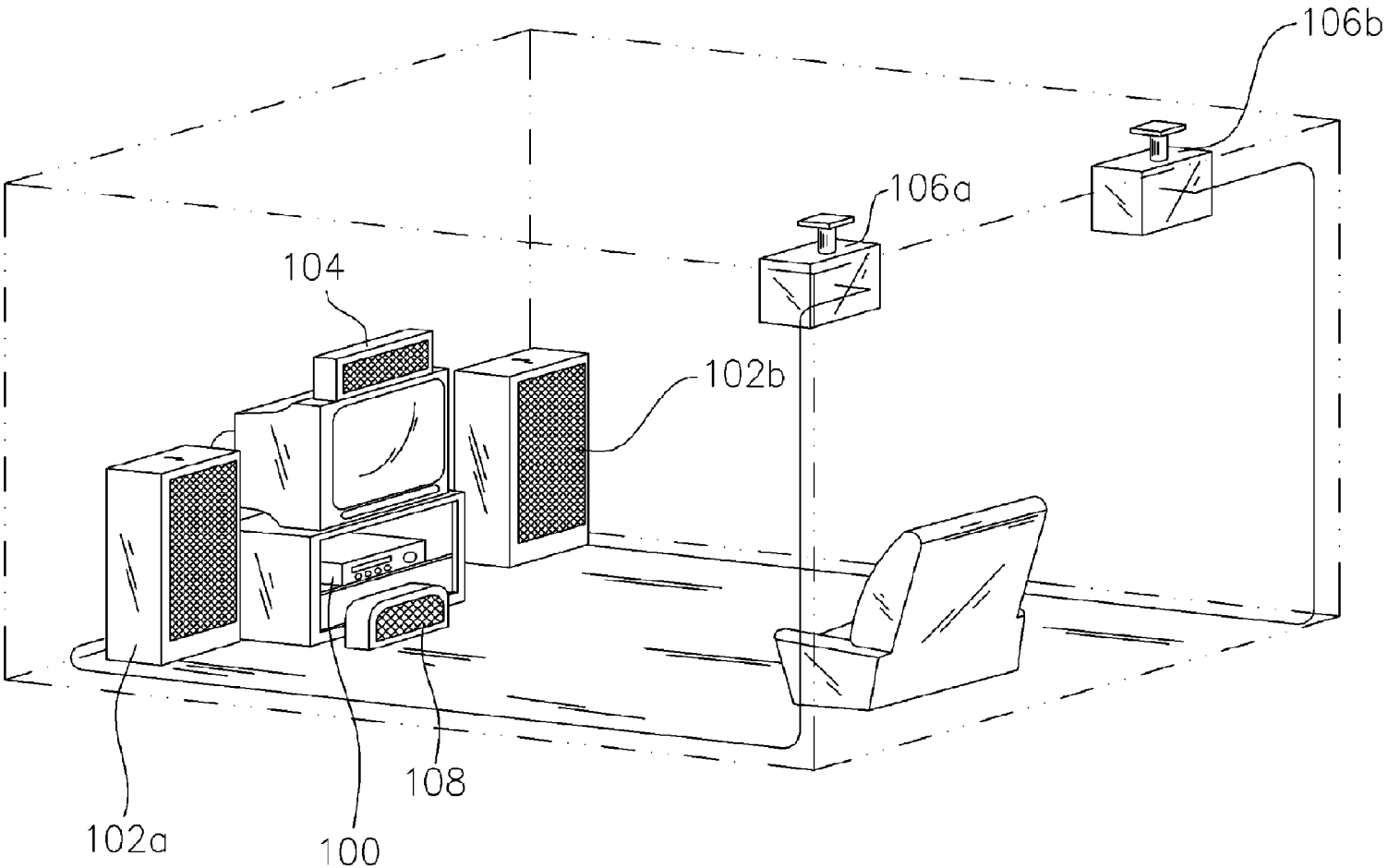
FIG. 1 (PRIOR ART)
FIG. 1 schematically shows a diagram of a home theater with a 5.1 channel speaker.
Figure 2A:
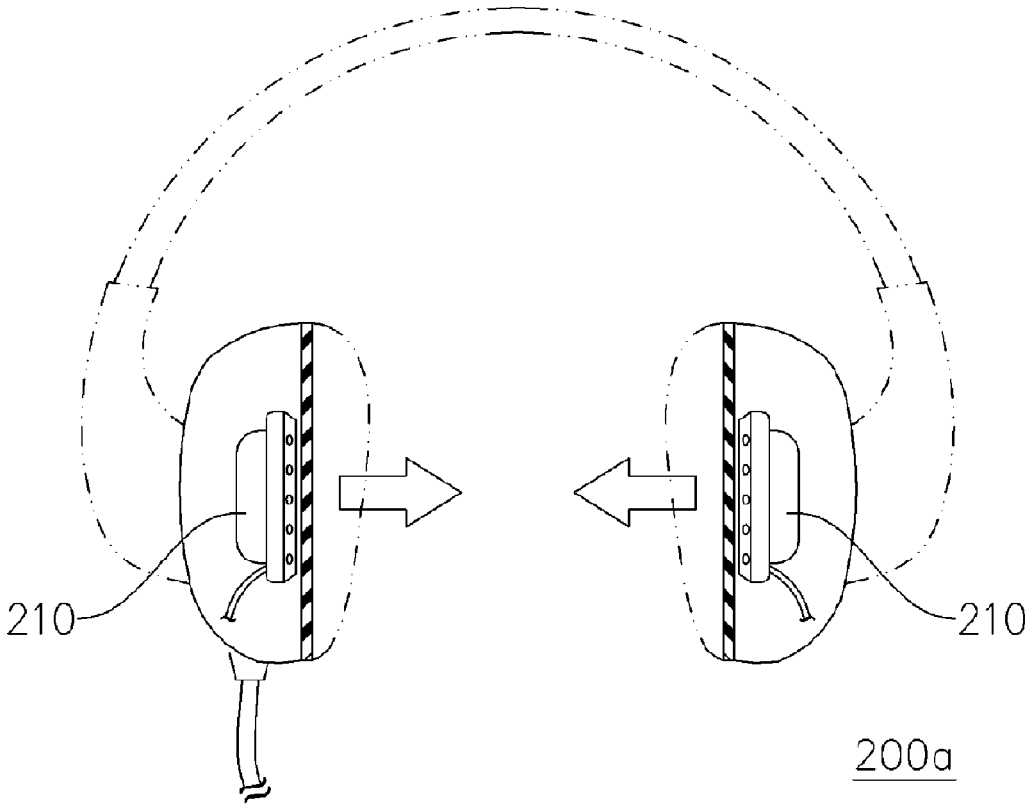
FIG. 2A (PRIOR ART)
FIG. 2A schematically shows a side view sectional diagram of a conventional earphone.
Figure 2B:
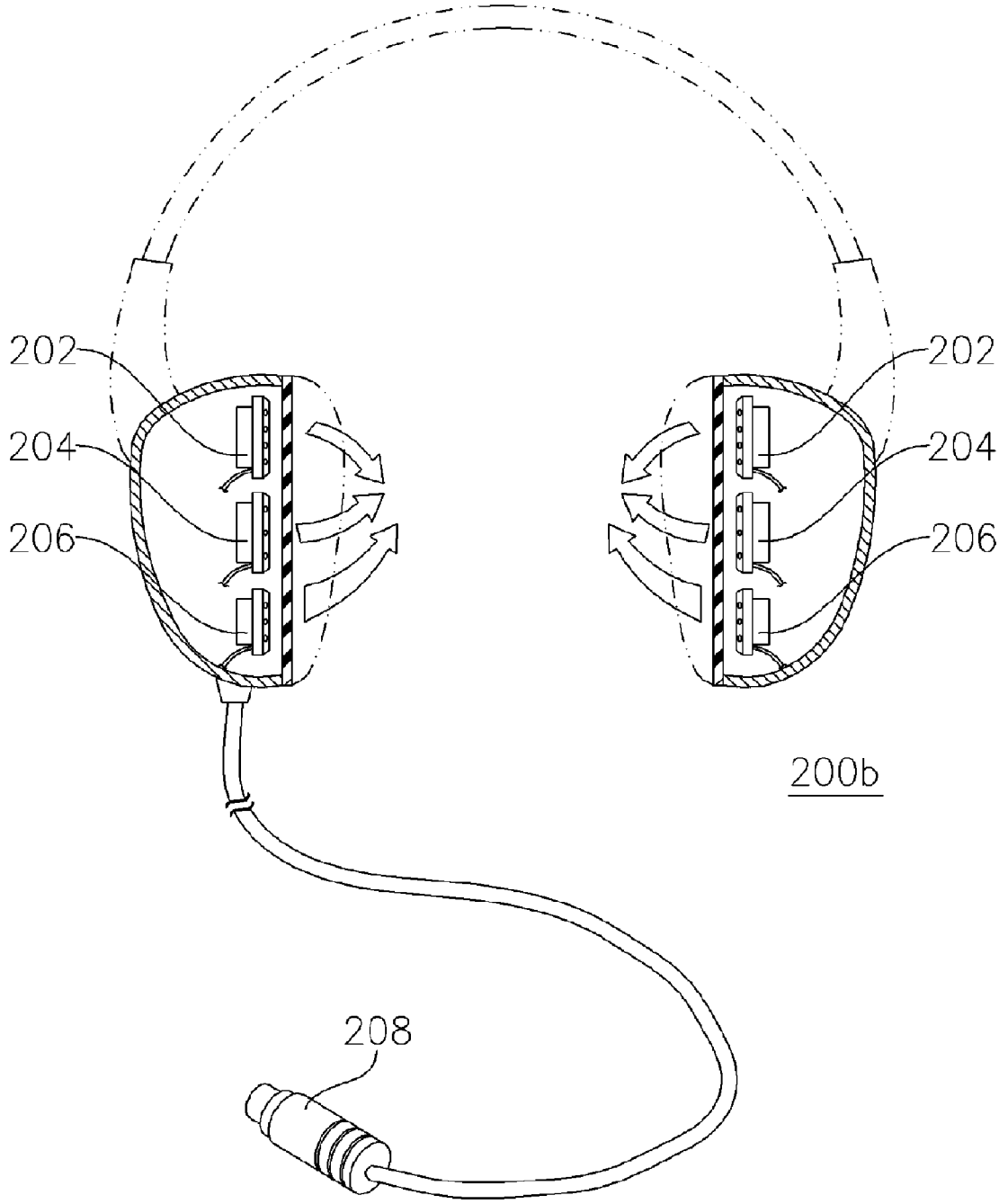
FIG. 2B (PRIOR ART)
FIG. 2B schematically shows a side view sectional diagram of another conventional earphone.

The present invention provides an earphone having an external tube disposed on the earphone main body. The earphone main body comprises a case and a cover of the earphone. Wherein, the case and the cover of the earphone togetherly form an interior chamber, and the spatial sound effect is improved by adjusting the space in the external tube. The space in the external tube is adjusted either by changing the length of the external tube or folding the external tube. In an embodiment of the present invention, any one of signal entities of the 5.1 channel sound source provided by the DVD player can be independently pulled out from the interior chamber of the earphone main body, and the space in the interior chamber is adjusted by changing the length of the interior chamber formed by the length-length-adjustable external tube. The shorter the external tube, the less space it occupies in the whole earphone. The longer the external tube, the more space the sound field provided by the whole system. In addition, when the length of the external tube is extended, one of the signal entities may be independently pulled out and disposed on the interior chamber, such that the spatial sound effect is improved.

Besides the earphone having an external chamber tube mentioned above, an earphone having an effect of balance sound field is further provided by the present invention. The earphone with a balance sound effect couples any one of the sound sources provided by the 5.1 channel sound sources from the DVD player to two or more than two speakers at the same time, and these two speakers, one is disposed on a speaker holder in the interior chamber and the other one is disposed in the external tube. In other words, at least one speaker is disposed inside the case of the earphone, and one speaker is disposed on the external tube coupled to the earphone main body. With such arrangement, a sound field is formed by these two or more than two speakers, which are coupled to a same sound source, based on the difference of the sounding point and the angle or physical location of the speakers, such that the sound field formed by this sound signal is enlarged and more saturated. These two or more than two speakers may be coupled to the sound signal either in parallel or in serial. By arranging two or more than two speakers on different location or with different angle, the physical sound field is enlarged and the sound is more saturated.

Besides the earphone having an external chamber tube mentioned above, an earphone having a function of dividing the sound field is further provided by the present invention. In this earphone, a tube is externally coupled to the earphone main body, and an interior chamber is formed on the outermost edge of the external tube. In addition, any one of the signal entities provided by the 5.1 channel sound sources from the DVD player is disposed in any direction or angle with respect to the case of the interior chamber, such that a resonance is formed inside the interior chamber. In another embodiment of the present invention, a curve tube is further coupled on the case of the interior chamber, such that the resonance is not directly created in the interior chamber. Accordingly, the sound source on the case of the interior chamber provided by the 5.1 channel of the DVD player is pulled away from the main sound field formed by the 5.1 channel. In other words, in the earphone of the present embodiment, a resonant chamber is formed by the case of the main body, thus the sound field is divided by changing the phase and frequency of the sound wave, and the sound wave inside the resonant chamber is transmitted to the main sound field inside the earphone main body with air media through the external tube.

A plurality of preferred embodiments are exemplified hereinafter for explaining principles of the present invention. To be noted that these embodiments are used for describing the present invention, and should not be used to limit the scope of the present invention.

Figure 3A:
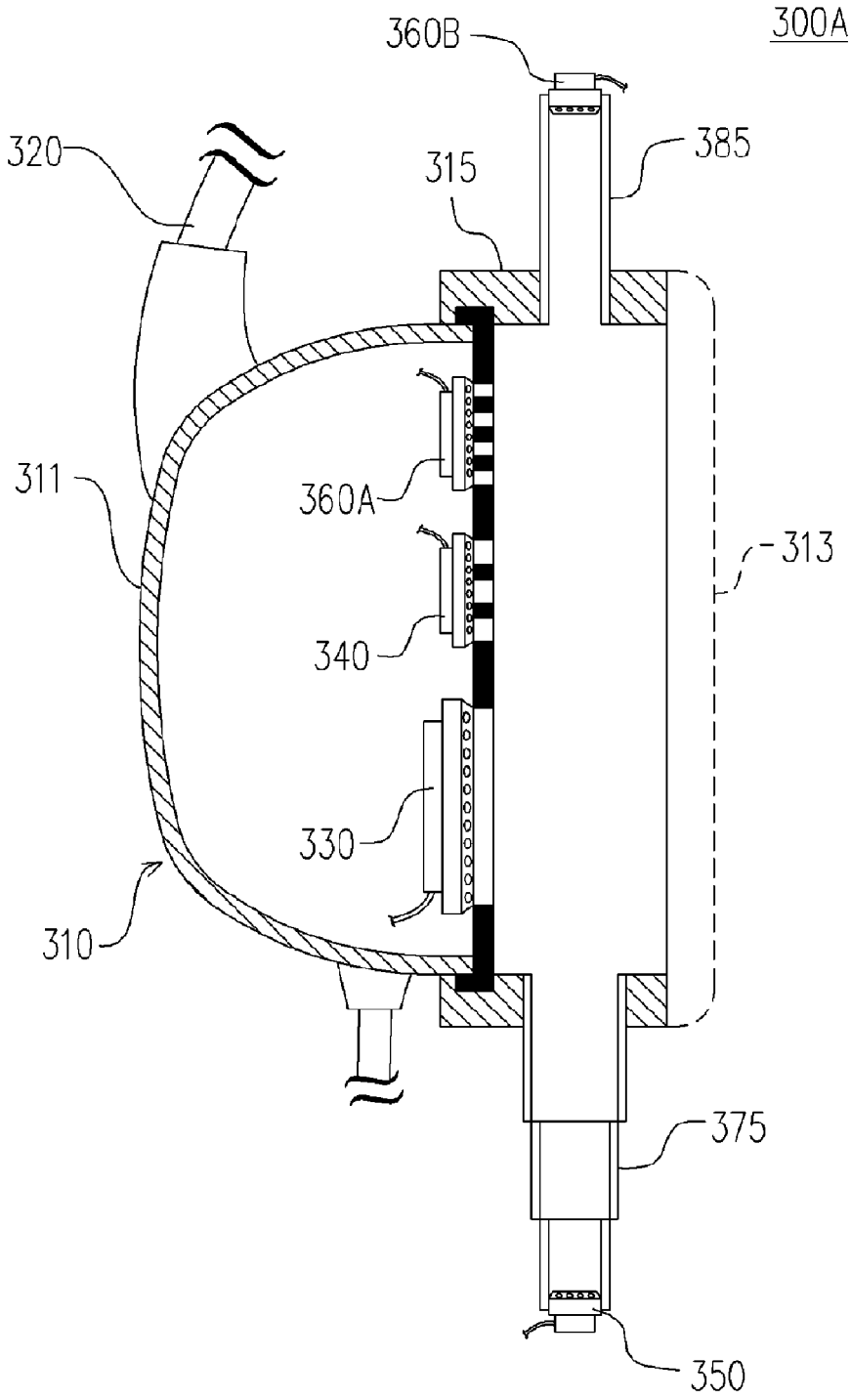
FIG. 3A schematically shows a partial sectional decomposition diagram of an earphone 300A in side view according to an embodiment of the present invention.

FIG. 3A schematically shows a partial sectional decomposition diagram of an earphone 300A in side view according to a preferred embodiment of the present invention. To be noted, although only one side of the earphone of the present invention is shown in FIG. 3A, it will be apparent to one of the ordinary skill in the art that the other side of the earphone, which is not shown in the diagram, is the same as the one shown in FIG. 3A, thus its detail is omitted here.

Referring to FIG. 3A, the earphone 300A comprises an earphone main body 310 and a connector 320. Wherein, the connector 320 is used to connect the earphone main body 310 in its both sides (only one side is shown in the diagram). The earphone main body 310 mainly comprises a case 311, a cover 313, and a case extension unit 315. The case extension unit 315 is actually an extension unit of the case 311, and is coupled to the cover 313. The earphone main body 310 further comprises a main speaker 330 and a plurality of sub-speakers 340, 350, 360A, and 360B, which are disposed inside the earphone main body 310. In addition, the earphone main body further comprises the external tubes 375 and 385 where the sub-speakers 350 and 360B are disposed on.

Inside the earphone 300A, as described above, it may only has one external tube 375 disposed on the case extension unit 315 of the earphone main body 310. The case 311, the cover 313, and the case extension unit 315 of the earphone 300A togetherly form a main chamber, and the spatial sound effect is improved by adjusting the space in the external tube 375. In addition, the space in the external tube in the present embodiment is adjusted by changing the length of the external tube.

Inside the earphone 300A of the present embodiment, as described above, it may be further comprised another external tube 385 disposed on the case extension unit 315 of the earphone main body 310. The case 311, the cover 313, and the case extension unit 315 of the earphone 300A togetherly form a main chamber, and the spatial sound effect is improved by adjusting the space in the external tube 385. In the present embodiment, the length of this additional added external tube 385 may be fixed, or may be adjustable or foldable based on the physical design requirement.

In the earphone 300A of the present embodiment, any one of the signal entities provided by the 5.1 channel of the DVD player, such as the sub-speaker 350 of FIG. 3A, may be independently pulled out and disposed on the external tube 375, and the space in the interior chamber formed by the length-adjustable external tube is adjusted by changing the length of the external tube. The shorter the external tube, the less space it occupies in the earphone 300A. The longer the external tube, the more space the sound field provided by the whole earphone 300A. In addition, when the length of the external tube is extended, one of the signal entities may be independently pulled out and disposed on the interior chamber, such that the spatial sound effect is improved. On the additionally added external tube 385 in the earphone 300A of the present embodiment, any one of the signal entities provided by the 5.1 channel of the DVD player, such as the sub-speaker 360B of FIG. 3A, may be independently pulled out and disposed on the external tube 385.

Besides the earphone 300A having an external tube mentioned above, an earphone 300A having an effect of balance sound field is further provided in another embodiment of the present invention. The earphone 300A with a balance sound effect couples any one of the sound sources provided by the 5.1 channel sound sources from the DVD player to two or more than two speakers at the same time, wherein one speaker is disposed on a speaker holder in the interior chamber and the other speaker is disposed in the external tube. For example, the sub-speaker 360A is disposed inside the case 311 of the earphone 300A, and the other sub-speaker 360B is disposed on the external tube 385 coupled to the earphone main body 310.

With such arrangement, a sound field is formed by these two or more than two sub-speakers 360A and 360B, which are coupled to a same sound source, based on the difference of the sounding point and the angle or physical location of the speakers, such that the sound field formed by this sound signal is enlarged and more saturated. These sub-speakers 360A and 360B may be coupled to the sound signal either in parallel or in serial. Alternatively, a different level sound field can be formed by disposing these two or more than two speakers on different locations and with different angles.

Figure 3B:
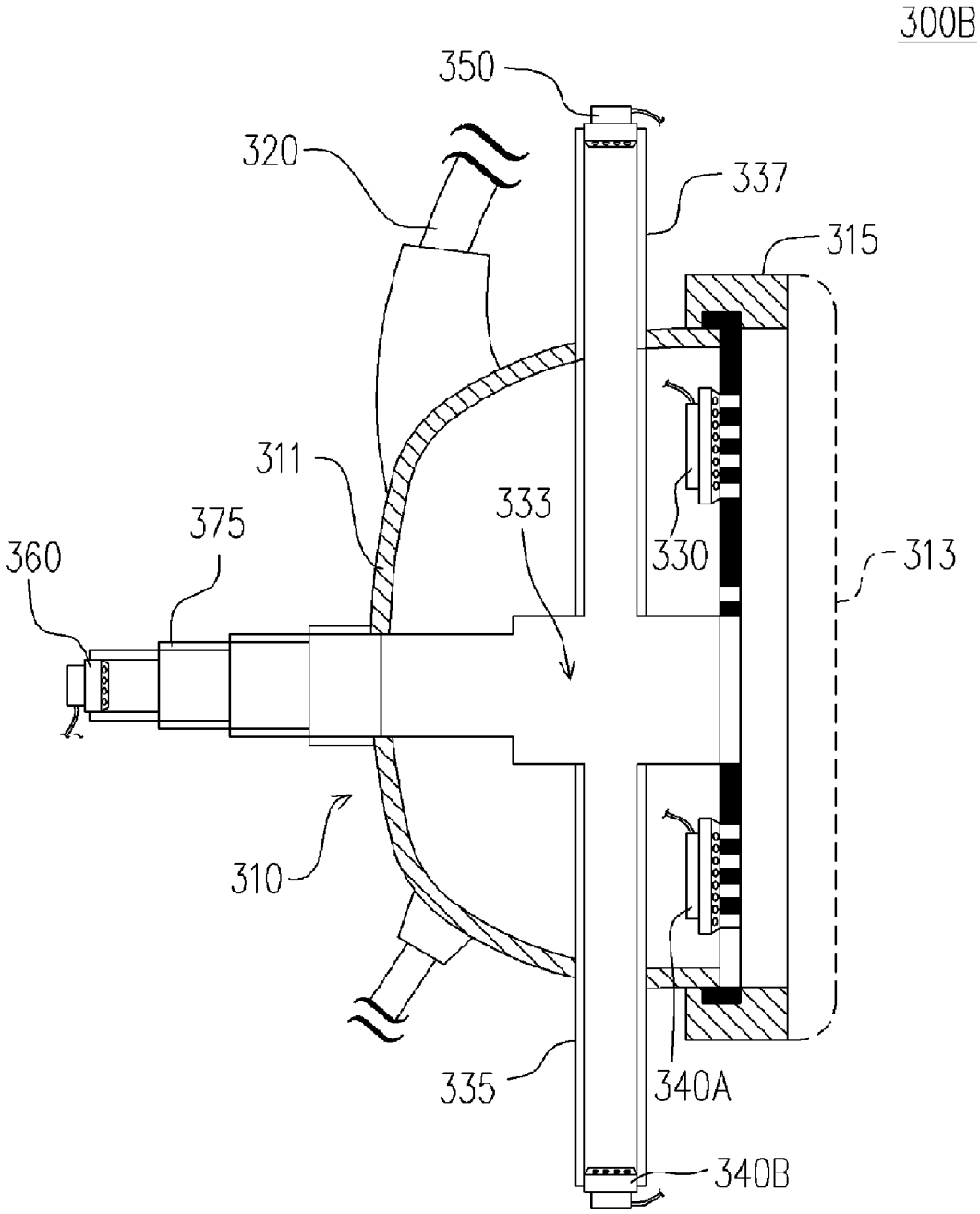
FIG. 3B schematically shows a partial sectional decomposition diagram of an earphone 300B in side view according to another embodiment of the present invention.

FIG. 3B schematically shows a partial sectional decomposition diagram of an earphone 300B in side view according to another preferred embodiment of the present invention. To be noted, although only one side of the earphone of the present invention is shown in FIG. 3B, it will be apparent to one of the ordinary skill in the art that the other side of the earphone, which is not shown in the diagram, is the same as the one shown in FIG. 3B, thus its detail is omitted here.

Referring to FIG. 3B, the earphone 300B comprises an earphone main body 310 and a connector 320. Wherein, the connector 320 is used to connect the earphone main body 310 in its both sides (only one side is shown in the diagram). The earphone main body 310 mainly comprises a case 311, a cover 313, and a case extension unit 315. The case extension unit 315 is actually an extension unit of the case 311, and is coupled to the cover 313. The earphone main body 310 further comprises a main speaker 330 and a plurality of sub-speakers 340A, 340B, 350, and 360, which are disposed inside the earphone main body 310. The sub-speakers 340B and 350 are disposed on the external tubes 335 and 337 on both side walls of a composite chamber 333, respectively. Alternatively, the sub-speakers 340B and 350 may be directly disposed on both side walls of a composite chamber 333, respectively. In addition, an external tube 375 where the sub-speaker 360 is disposed on is further comprised in the present embodiment. The earphone structure with a composite sound field had been disclosed in contents of the ROC patent number 93107621 titled as "EARPHONE STRUCTURE WITH A COMPOSITE SOUND FIELD" by the same applicant on Mar. 22, 2004, the ROC patent number 93111985 as an extended application titled as "EARPHONE STRUCTURE WITH A COMPOSITE SOUND FIELD" by the same applicant on Apr. 29, 2004, and the U.S. patent Ser. No. 10/709,956 titled as "EARPHONE STRUCTURE WITH A COMPOSITE SOUND FIELD" by the same applicant on Jun. 9, 2004, which all disclosures are incorporated herewith. The applicant claims herein that the composite sound field disclosed in the applications mentioned above and the composite sound effect described in the present embodiments are all suitable for the earphone of the present invention.

The difference between the earphone 300B and the one shown in FIG. 3A is the external tube 375 of FIG. 3A is disposed on the case extension unit 315 of the earphone main body 310. While in the present embodiment, the external tube 375 is disposed on the case 311 of the earphone main body 310 and directly extended from the composite chamber 333. The case 311, the cover 313, and the case extension unit 315 of the earphone 300B togetherly form a main chamber, and the spatial sound effect is improved by adjusting the space in the composite chamber 333 and the external tube 375. In addition, the space in the external tube in the present embodiment is adjusted by changing the length of the external tube.

Inside the earphone 300B of the present embodiment, the sub-speakers 340B and 350 are disposed on the external tubes 335 and 337 on both side walls of the composite chamber 333, respectively. The spatial sound effect is improved by adjusting the space in the external tubes 335 and 337. In the present embodiment, the length of these additional added external tubes 335 and 337 may be fixed, or may be adjustable or foldable based on the physical design requirement.

Besides the earphone 300B having an external tube mentioned above, in another embodiment of the present invention, the earphone 300B also provides an effect of balance sound field. The earphone 300B with a balance sound effect couples any one of the sound sources provided by the 5.1 channel sound sources from the DVD player to two or more than two speakers at the same time, wherein one speaker is disposed on a speaker holder in the interior chamber and the other speaker is disposed in the external tube. For example, the sub-speaker 340A is disposed inside the case 311 of the earphone 300B, and the other sub-speaker 340B is disposed on the external tube 335 on the composite chamber 333. The sub-speakers 340A and 340B are coupled to the surrounding sound source of the 5.1 channel, the sub-speaker 350 is coupled to the center sound source of the 5.1 channel, and the sub-speaker 360 is coupled to the subwoofer of the 5.1 channel. With such arrangement, a sound field is formed by these two or more than two sub-speakers 340A and 340B, which are coupled to a same sound source, based on the difference of the sounding point and the angle or physical location of the speakers, such that the sound field formed by this sound signal is enlarged and more saturated. These sub-speakers 340A and 340B may be coupled to the sound signal either in parallel or in serial. Alternatively, a different level sound field can be formed by disposing these two or more than two speakers on different locations and with different angles.

Figure 3C:
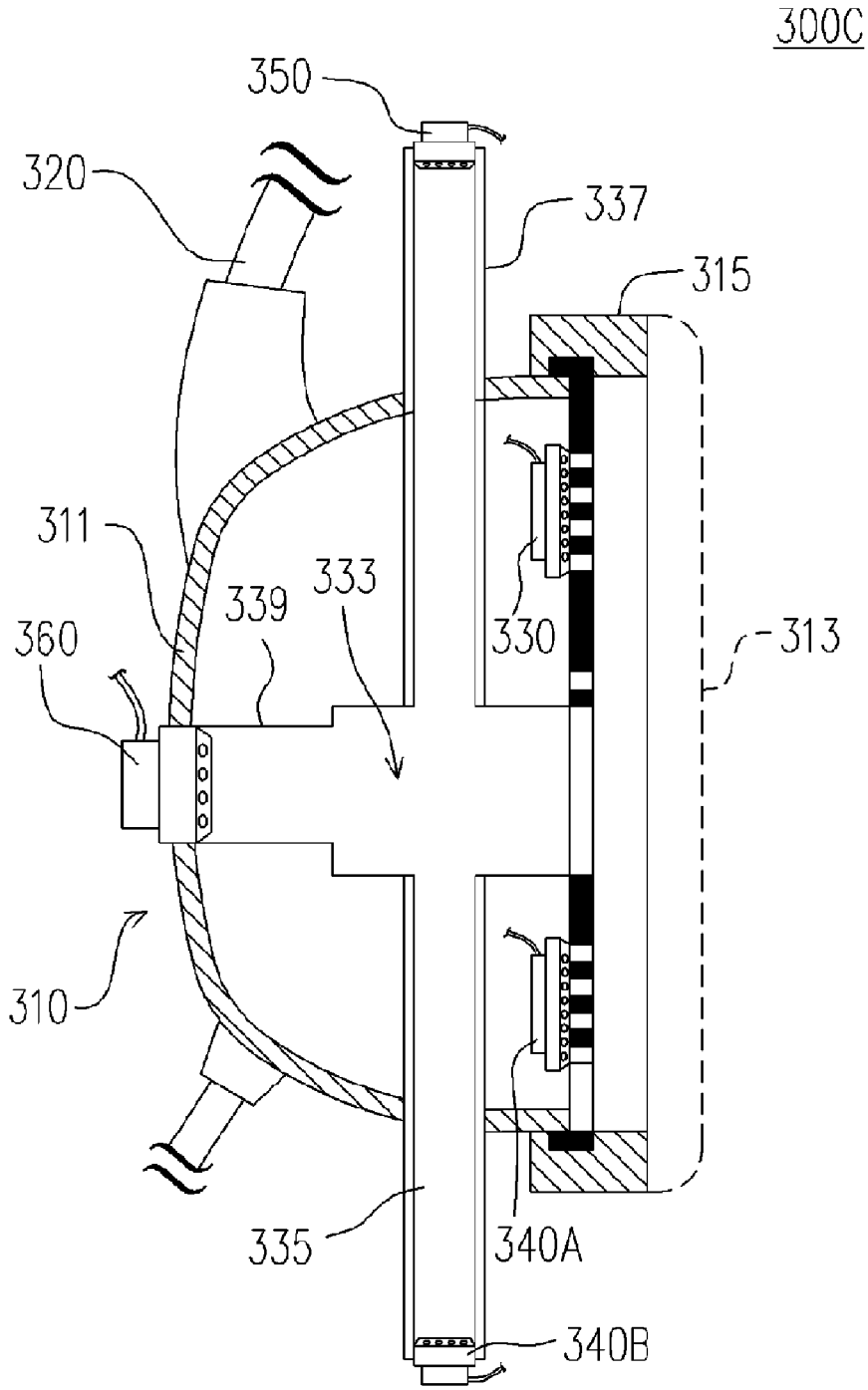
FIG. 3C schematically shows a partial sectional decomposition diagram of an earphone 300C in side view according to yet another embodiment of the present invention.

FIG. 3C schematically shows a partial sectional decomposition diagram of an earphone 300C in side view according to another preferred embodiment of the present invention. To be noted, although only one side of the earphone of the present invention is shown in FIG. 3C, it will be apparent to one of the ordinary skill in the art that the other side of the earphone, which is not shown in the diagram, is the same as the one shown in FIG. 3C, thus its detail is omitted here.

Referring to FIG. 3C, the earphone 300C comprises an earphone main body 310 and a connector 320. Wherein, the connector 320 is used to connect the earphone main body 310 in its both sides (only one side is shown in the diagram). The earphone main body 310 mainly comprises a case 311, a cover 313, and a case extension unit 315. The case extension unit 315 is actually an extension unit of the case 311, and is coupled to the cover 313. The earphone main body 310 further comprises a main speaker 330 and a plurality of sub-speakers 340A, 340B, 350, and 360, which are disposed inside the earphone main body 310. The sub-speakers 340B and 350 are disposed on the external tubes 335 and 337 on both side walls of a composite chamber 333, respectively. Alternatively, the sub-speakers 340B and 350 may be directly disposed on both side walls of a composite chamber 333, respectively. In addition, an external tube 339 where the sub-speaker 360 is disposed on is further comprised in the present embodiment.

The difference between the earphone 300C and the one shown in FIG. 3B is the external tube 339 is directly extended from the composite chamber 333, such that the sub-speaker 360 is disposed on the case 311. The case 311, the cover 313, and the case extension unit 315 of the earphone 300C togetherly form a main chamber, and the spatial sound effect is improved by adjusting the space in the composite chamber 333 and the external tubes 335, 337, and 339. In addition, the length of these additional added external tubes 335, 337, and 339 may be fixed, or may be adjustable or foldable based on the physical design requirement.

Figure 4A:
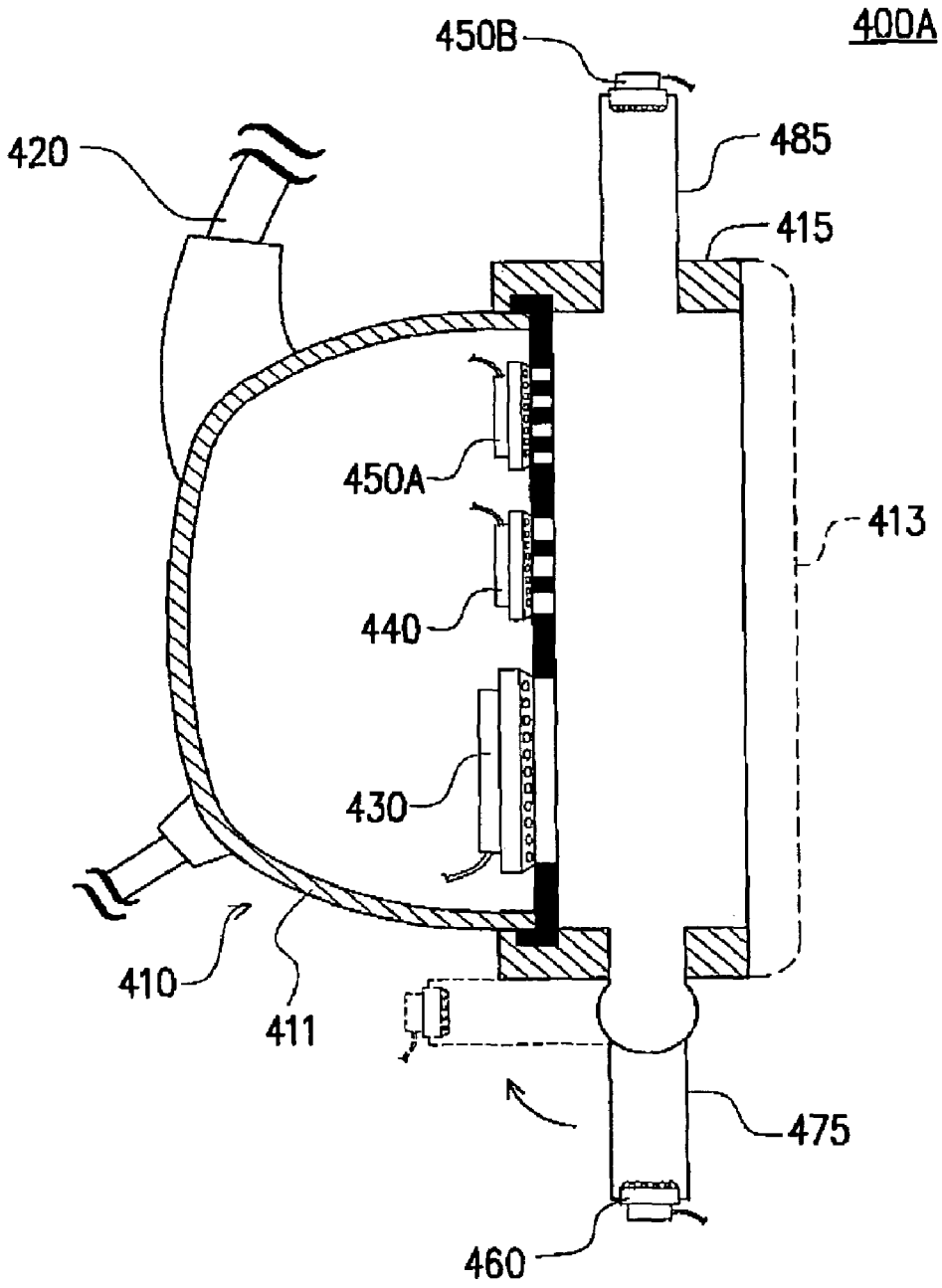
FIG. 4A schematically shows a partial sectional decomposition diagram of an earphone 400A in side view according to yet another embodiment of the present invention.

FIG. 4A schematically shows a partial sectional decomposition diagram of an earphone 400A in side view according to another preferred embodiment of the present invention. To be noted, although only one side of the earphone of the present invention is shown in FIG. 4A, it will be apparent to one of the ordinary skill in the art that the other side of the earphone, which is not shown in the diagram, is the same as the one shown in FIG. 4A, thus its detail is omitted here.

Referring to FIG. 4A, the earphone 400A comprises an earphone main body 410 and a connector 420. Wherein, the connector 420 is used to connect the earphone main body 410 in its both sides (only one side is shown in the diagram).

The earphone main body 410 mainly comprises a case 411, a cover 413, and a case extension unit 415. The earphone main body 410 further comprises a main speaker 430 and a plurality of sub-speakers 440, 450A, 450B, and 460, which are disposed inside the earphone main body 410. In addition, the external tubes 475 and 485 where the sub-speakers 460 and 450B are disposed on are further comprised in the present embodiment.

Inside the earphone 400A, as described above, it may only has one external tube 475 disposed on the case extension unit 415 of the earphone main body 410. The case 411, the cover 413, and the case extension unit 415 of the earphone 400A togetherly form a main chamber, and the spatial sound effect is improved by adjusting the space in the external tube 475. The difference between the embodiments of FIG. 4A and FIG. 3A is the space in the external tube 475 in the present embodiment is adjusted by folding the external tube 475. As described above, inside the earphone 400A of the present embodiment, it may be further comprised another external tube 485 disposed on the case extension unit 415 of the earphone main body 410. The case 411, the cover 413, and the case extension unit 415 of the earphone 400A togetherly form a main chamber, and the spatial sound effect is improved by adjusting the space in the external tube 485. In the present embodiment, the length of this additional added external tube 485 may be fixed, or may be adjustable or foldable based on the physical design requirement.

In the earphone 400A of the present embodiment, any one of the signal entities provided by the 5.1 channel of the DVD player, such as the sub-speaker 460 of FIG. 4A, may be independently pulled out and disposed on the external tube 475, and the space in the interior chamber formed by the foldable external tube is adjusted by folding the external tube with different angle. The closer the external tube is folded toward to the earphone 400A, the less space it takes. On the additionally added external tube 485 in the earphone 400A of the present embodiment, any one of the signal entities provided by the 5.1 channel of the DVD player, such as the sub-speaker 450B of FIG. 4, may be independently pulled out and disposed on the external tube 485.

Besides the earphone 400A having an external tube mentioned above, an earphone 400A having an effect of balance sound field is further provided in another embodiment of the present invention. The earphone 400A with a balance sound effect couples any one of the sound sources provided by the 5.1 channel sound sources from the DVD player to two or more than two speakers at the same time, wherein one speaker is disposed on a speaker holder in the interior chamber and the other speaker is disposed in the external tube. For example, the sub-speaker 450A is disposed inside the case 411 of the earphone 400A, and the other sub-speaker 450B is disposed on the external tube 485 coupled to the case.

With such arrangement, a sound field is formed by these two or more than two sub-speakers 450A and 450B, which are coupled to a same sound source, based on the difference of the sounding point and the angle or physical location of the speakers, such that the sound field formed by this sound signal is enlarged and more saturated. These sub-speakers 450A and 450B may be coupled to the sound signal either in parallel or in serial. Alternatively, a different level sound field can be formed by disposing these two or more than two speakers on different locations and with different angles.

Figure 4B:
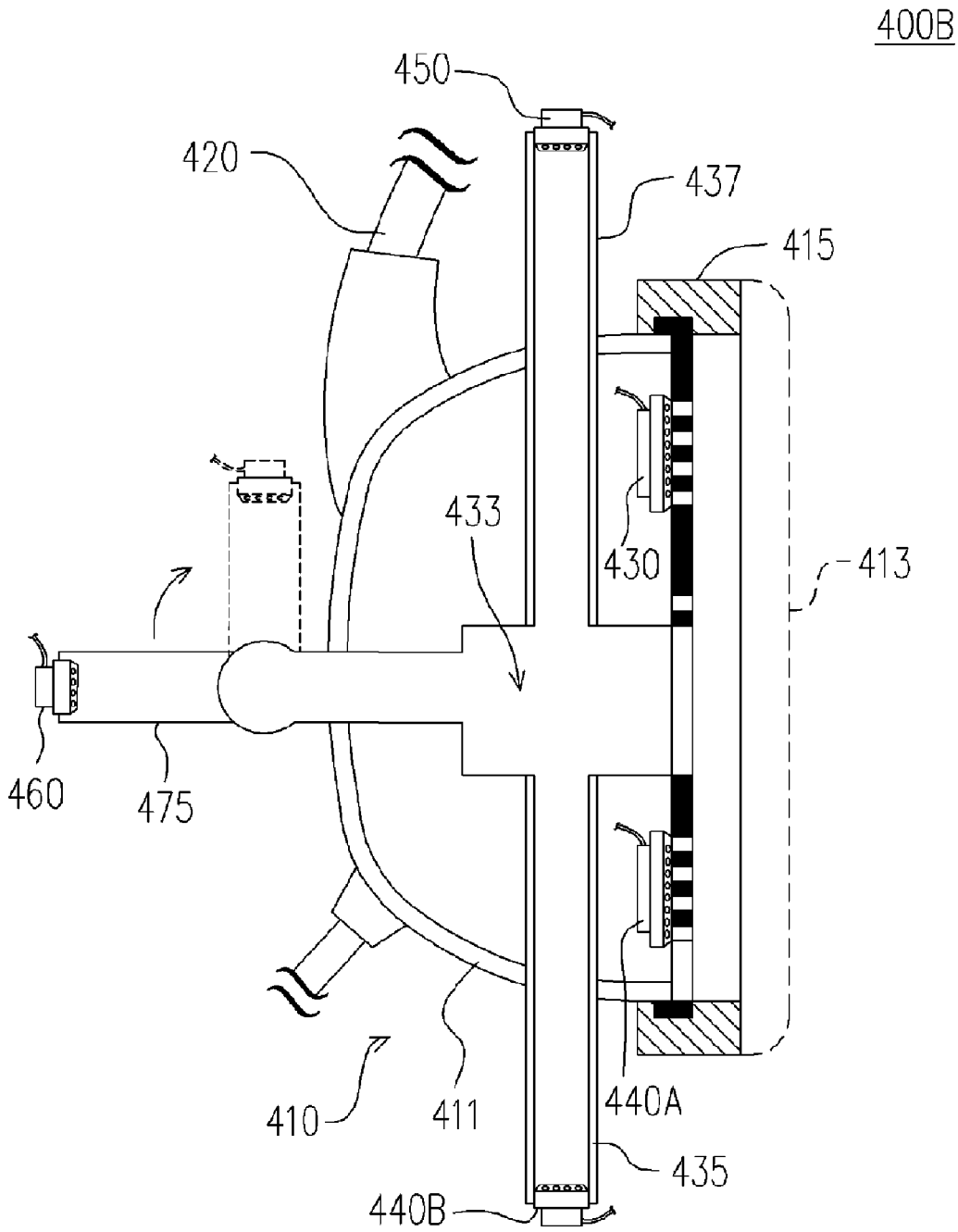
FIG. 4B schematically shows a partial sectional decomposition diagram of an earphone 400B in side view according to yet another embodiment of the present invention.

FIG. 4B schematically shows a partial sectional decomposition diagram of an earphone 400B in side view according to another preferred embodiment of the present invention. To be noted, although only one side of the earphone of the present invention is shown in FIG. 4B, it will be apparent to one of the ordinary skill in the art that the other side of the earphone, which is not shown in the diagram, is the same as the one shown in FIG. 4B, thus its detail is omitted here.

Referring to FIG. 4B, the earphone 400B comprises an earphone main body 410 and a connector 420. Wherein, the connector 420 is used to connect the earphone main body 410 in its both sides (only one side is shown in the diagram). The earphone main body 410 mainly comprises a case 411, a cover 413, and a case extension unit 415. The earphone main body 410 further comprises a main speaker 430 and a plurality of sub-speakers 440A, 440B, 450, and 460, which are disposed inside the earphone main body 410. The sub-speakers 440B and 450 are disposed on the external tubes 435 and 437 on both side walls of a composite chamber 433, respectively. In addition, an external tube 475 where the sub-speaker 460 is disposed on is further comprised in the present embodiment.

The difference between the earphone 400B and the one shown in FIG. 4A is the external tube 475 of FIG. 4A is disposed on the case extension unit 415 of the earphone main body 410. While in the present embodiment, the external tube 475 is disposed on the case 411 of the earphone main body 410 and the chamber is an extension of the composite chamber 433 inside the earphone main body 410. The case 411, the cover 413, and the case extension unit 415 of the earphone 400B togetherly form a main chamber, and the spatial sound effect is improved by adjusting the space in the external tube 475. It is differed from the embodiment of FIG. 3B in that the space in the external tube 475 is adjusted by folding the external tube with different angle in the present embodiment.

As described above, inside the earphone 400B of the present embodiment, both side walls of the composite chamber 433 are extended to the external tubes 435 and 437 out the case 411. The case 411and the cover 413 of the earphone 400B togetherly form a main chamber, and the spatial sound effect is improved by adjusting the space in the external tubes 435 and 437. In the present embodiment, the length of these additional added external tubes 435 and 437 may be fixed, or may be adjustable or foldable based on the physical design requirement.

In the earphone 400B of the present embodiment, any one of the signal entities provided by the 5.1 channel of the DVD player, such as the sub-speaker 460 of FIG. 4B, may be independently pulled out and disposed on the external tube 475, and the space in the interior chamber formed by the foldable external tube is adjusted by folding the external tube with different angle. The closer the external tube is folded toward to the earphone 400B, the less space it takes. On the external tubes 435 and 437, which are extended from the both side walls of the composite chamber 433 in the earphone 400B of the present embodiment, any one of the signal entities provided by the 5.1 channel of the DVD player, such as the sub-speakers 440B and 450 of FIG. 4B, may be independently pulled out and disposed on the external tubes 435 and 437, respectively.

Besides the earphone 400B having an external tube mentioned above, an earphone 400B having an effect of balance sound field is further provided in another embodiment of the present invention. The earphone 400B with a balance sound effect couples any one of the sound sources provided by the 5.1 channel sound sources from the DVD player to two or more than two speakers at the same time, wherein one speaker is disposed on a speaker holder in the interior chamber and the other speaker is disposed in the external tube. For example, the sub-speaker 440A is disposed inside the case 411 of the earphone 400B, and the other sub-speaker 440B is disposed on the external tube 435 coupled to the composite chamber 433. The sub-speakers 440A and 440B are coupled to the surrounding sound source of the 5.1 channel, the sub-speaker 450 is coupled to the center sound source of the 5.1 channel, and the sub-speaker 460 is coupled to the subwoofer of the 5.1 channel.

With such arrangement, a sound field is formed by these two or more than two sub-speakers 440A and 440B, which are coupled to a same sound source, based on the difference of the sounding point and the angle or physical location of the speakers, such that the sound field formed by this sound signal is enlarged and more saturated. These sub-speakers 440A and 440B may be coupled to the sound signal either in parallel or in serial. Alternatively, a different level sound field can be formed by disposing these two or more than two speakers on different locations and with different angles.

Figure 5A:
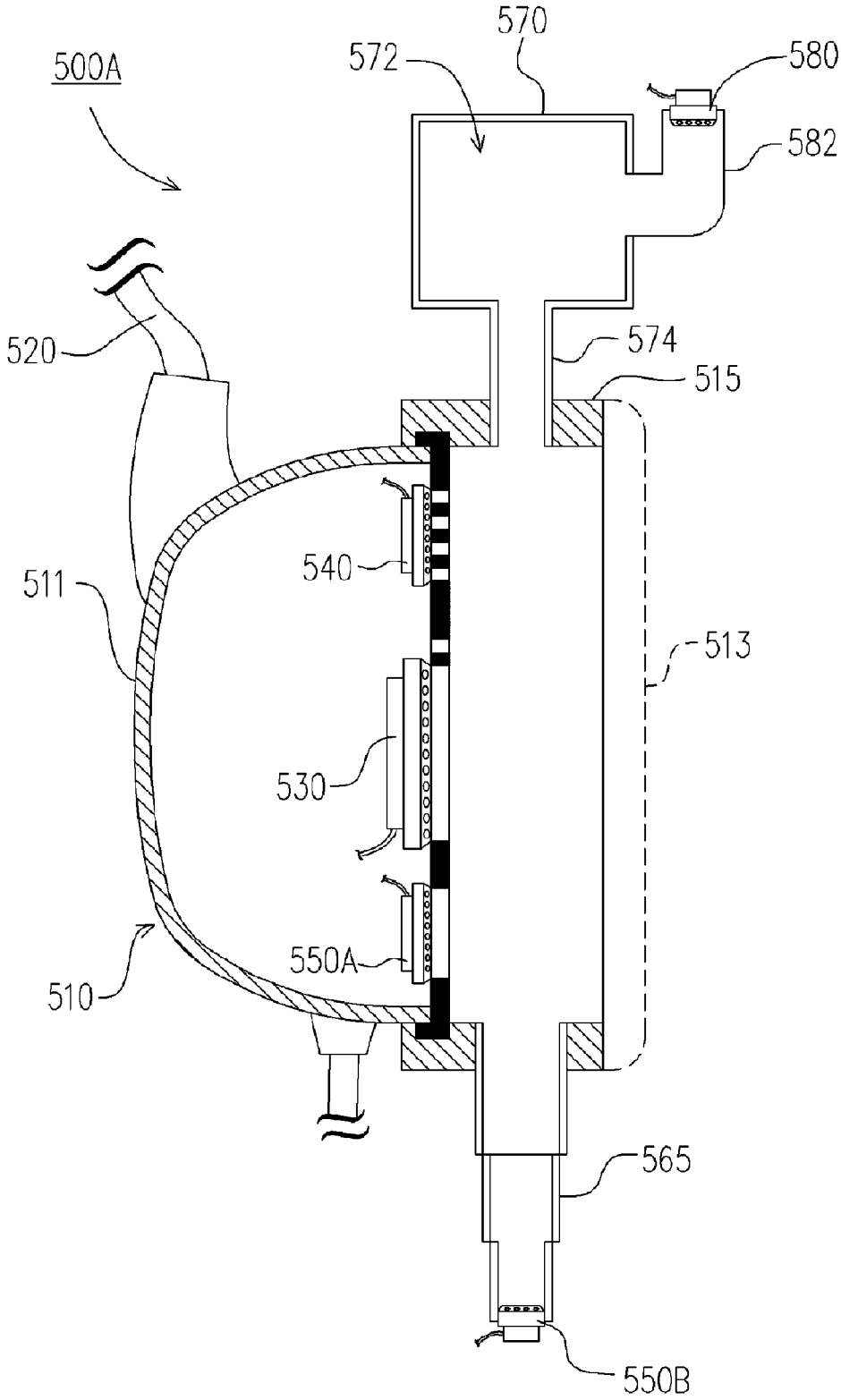
FIG. 5A schematically shows a partial sectional decomposition diagram of an earphone 500A in side view according to yet another embodiment of the present invention.

FIG. 5A schematically shows a partial sectional decomposition diagram of an earphone 500A in side view according to another preferred embodiment of the present invention. To be noted, although only one side of the earphone of the present invention is shown in FIG. 5A, it will be apparent to one of the ordinary skill in the art that the other side of the earphone, which is not shown in the diagram, is the same as the one shown in FIG. 5A, thus its detail is omitted here.

Referring to FIG. 5A, the earphone 500A comprises an earphone main body 510 and a connector 520. Wherein, the connector 520 is used to connect the earphone main body 510 in its both sides (only one side is shown in the diagram). The earphone main body 510 mainly comprises a case 511, a cover 513, and a case extension unit 515. The earphone main body 510 further comprises a main speaker 530 and a plurality of sub-speakers 540 and 550A, which are disposed inside the earphone main body 510. In addition, an external tube 565 where the sub-speaker 550B is disposed on is further comprised in the present embodiment. Alternatively, an interior chamber 570 coupled to an external tube 574 may be further comprised in the present embodiment, and its detail is described hereinafter.

Inside the earphone 500A, as described above, it may only has one external tube 565 disposed on the case extension unit 515 of the earphone main body 510. The case 511 and the cover 513 of the earphone 500A togetherly form a main chamber, and the spatial sound effect is improved by adjusting the space in the external tube 565. In addition, the space in the external tube in the present embodiment is adjusted by changing the length of the external tube.

In the earphone 500A of the present embodiment, any one of the signal entities provided by the 5.1 channel of the DVD player, such as the sub-speaker 550B of FIG. 5A, may be independently pulled out and disposed on the external tube 565, and the space in the interior chamber formed by the length-adjustable external tube is adjusted by changing the length of the external tube. The shorter the external tube, the less space it occupies in the earphone 500A. The longer the external tube, the more space the sound field provided by the whole earphone 500A. In addition, when the length of the external tube is extended, one of the signal entities may be independently pulled out and disposed on the interior chamber, such that the spatial sound effect is improved.

Besides the earphone 500A having an external tube mentioned above, an earphone 500A having an effect of balance sound field is further provided in another embodiment of the present invention. The earphone 500A with a balance sound effect couples any one of the sound sources provided by the 5.1 channel sound sources from the DVD player to two or more than two speakers at the same time, wherein one speaker is disposed on a speaker holder in the interior chamber and the other speaker is disposed in the external tube. For example, the sub-speaker 550A is disposed inside the case 511 of the earphone 500A, and the other sub-speaker 550B is disposed on the external tube 565 coupled to the case extension unit 515.

With such arrangement, a sound field is formed by these two or more than two sub-speakers 550A and 550B, which are coupled to a same sound source, based on the difference of the sounding point and the angle or physical location of the speakers, such that the sound field formed by this sound signal is enlarged and more saturated. These sub-speakers 550A and 550B may be coupled to the sound signal either in parallel or in serial. Alternatively, a different level sound field can be formed by disposing these two or more than two speakers on different locations and with different angles.

Besides the earphone having an external tube mentioned above, an earphone 500A having a function of dividing the sound field is further provided in the present embodiment. An external tube 574 is externally coupled to the case extension unit 515 of the earphone main body 510. An interior chamber 570 is formed on the outermost edge of the external tube 574, and a chamber 572 is formed in the interior chamber 570. In the present embodiment, any one of the signal entities provided by the 5.1 channel sound sources from the DVD player may be disposed on the cover of the interior chamber 570 with any angle and direction, so as to form a resonance in the chamber.

In an embodiment of the present invention, a curve tube 582 is further coupled on the case of the interior chamber 570 for not creating the resonance in the chamber 572 directly. Accordingly, the sound source on the case of the interior chamber provided by the 5.1 channel of the DVD player is pulled away from the main sound field formed by the 5.1 channel. The angle of the curve tube 582 is 10~180 degrees, and preferably to be about 90 degrees for easily adjusting the phase of the sound field. In the earphone 500A of the present embodiment, any one of the signal entities provided by the 5.1 channel of the DVD player, such as the sub-speaker 580 of FIG. 5A, may be independently pulled out and disposed on the outer edge of the curve tube 582. In the earphone 500A of the present embodiment, a resonant chamber is formed outside of the earphone main body 510, and the resonant chamber is adjusted by the curve tube 582. In the whole structure, the sound wave inside the resonant chamber is transmitted to the main sound field inside the case 511 with air media through the external tube 574.

As described above, the earphone provided by the present invention comprises an external tube disposed on the case. In addition, the case and the cover of the earphone togetherly form an interior chamber, and by adjusting the space in the external tube, the spatial sound effect is improved and the phase of the sound field is further adjusted.

Figure 5B:
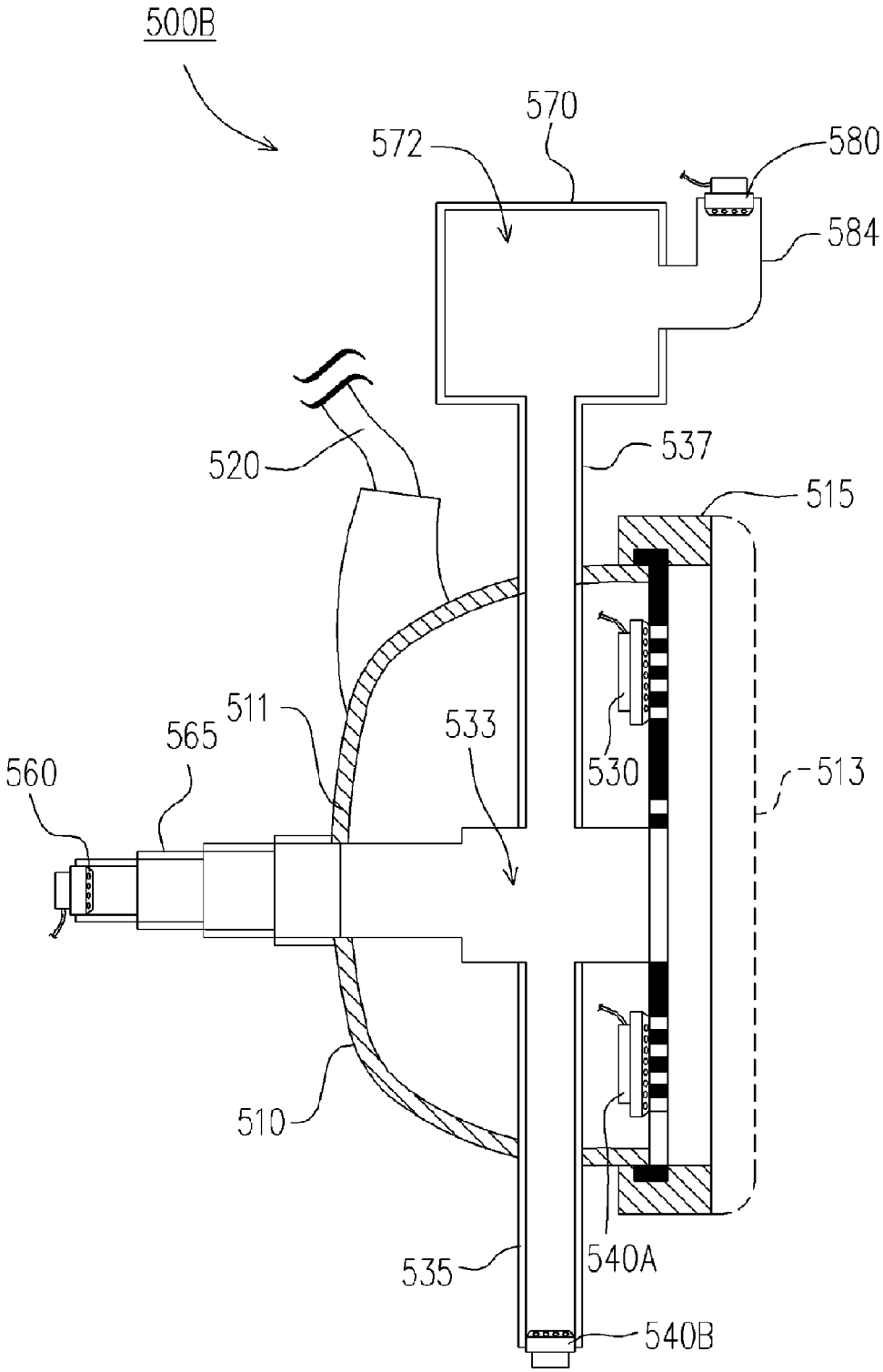
FIG. 5B schematically shows a partial sectional decomposition diagram of an earphone 500B in side view according to yet another embodiment of the present invention.

FIG. 5B schematically shows a partial sectional decomposition diagram of an earphone 500B in side view according to another preferred embodiment of the present invention. To be noted, although only one side of the earphone of the present invention is shown in FIG. 5B, it will be apparent to one of the ordinary skill in the art that the other side of the earphone, which is not shown in the diagram, is the same as the one shown in FIG. 5B, thus its detail is omitted here.

Referring to FIG. 5B, the earphone 500B comprises an earphone main body 510 and a connector 520. Wherein, the connector 520 is used to connect the earphone main body 510 in its both sides (only one side is shown in the diagram). The earphone main body 510 mainly comprises a case 511, a cover 513, and a case extension unit 515. The earphone main body 510 further comprises a main speaker 530 and a plurality of sub-speakers 540A, 540B, 560, and 570, which are disposed inside the earphone main body 510. The sub-speaker 540B is disposed on the external tube 565 which is extended from the side wall of the composite chamber 533. In addition, the external tube 565 where the sub-speaker 560 is disposed on is further comprised in the present embodiment. In addition, an interior chamber 570 coupled to the external tube 537 is further comprised in the present embodiment, and its detail is described in detail hereinafter.

The difference between the earphone 500B and the one shown in FIG. 5A is the external tubes 565 and 537 of FIG. 5A are disposed on the case extension unit 515 of the earphone main body 510. While in the present embodiment, the external tubes 565 and 537 are disposed on the case 511 of the earphone main body 510 and extended from the composite chamber 533 in the earphone main body 510.

Inside the earphone 500B, as described above, it may only has one external tube 565 disposed on the case 511 of the earphone main body 510. The case 511 and the cover 513 of the earphone 500B togetherly form a main chamber, and the spatial sound effect is improved by adjusting the space in the external tube 565. In addition, the space in the external tube in the present embodiment is adjusted by changing the length of the external tube.

In the earphone 500B of the present embodiment, any one of the signal entities provided by the 5.1 channel of the DVD player, such as the sub-speaker 560 of FIG. 5B, may be independently pulled out and disposed on the external tube 565, and the space in the interior chamber formed by the length-adjustable external tube is adjusted by changing the length of the external tube. The shorter the external tube, the less space it occupies in the earphone 500B. The longer the external tube, the more space the sound field provided by the whole earphone 500B. In addition, when the length of the external tube is extended, one of the signal entities may be independently pulled out and disposed on the interior chamber, such that the spatial sound effect is improved.

Besides the earphone 500B having an external tube mentioned above, an earphone 500B having an effect of balance sound field is further provided in another embodiment of the present invention. The earphone 500B with a balance sound effect couples any one of the sound sources provided by the 5.1 channel sound sources from the DVD player to two or more than two speakers at the same time, wherein one speaker is disposed on a speaker holder in the interior chamber and the other speaker is disposed in the external tube. For example, the sub-speaker 540A is disposed inside the case 511 of the earphone 500B, and the other sub-speaker 540B is disposed on the external tube 535 that is extended from the side wall of the composite chamber 533.

With such arrangement, a sound field is formed by these two or more than two sub-speakers 540A and 540B, which are coupled to a same sound source, based on the difference of the sounding point and the angle or physical location of the speakers, such that the sound field formed by this sound signal is enlarged and more saturated. These sub-speakers 540A and 540B may be coupled to the sound signal either in parallel or in serial. Alternatively, a different level sound field can be formed by disposing these two or more than two speakers on different locations and with different angles.

Besides the earphone having an external tube mentioned above, an earphone 500B having a function of dividing the sound field is further provided in the present embodiment. An external tube 537 is extended from the side wall of the composite chamber 533 of the earphone main body 510. An interior chamber 570 is formed on the outermost edge of the external tube 537, and a chamber 572 is formed in the interior chamber 570. In the present embodiment, any one of the signal entities provided by the 5.1 channel sound sources from the DVD player may be disposed on the cover of the interior chamber 570 with any angle and direction, so as to form a resonance in the chamber.

In an embodiment of the present invention, a curve tube 584 is further coupled on the case of the interior chamber 570 for not creating the resonance in the chamber 572 directly. Accordingly, the sound source on the case of the interior chamber provided by the 5.1 channel of the DVD player is pulled away from the main sound field formed by the 5.1 channel. The angle of the curve tube 584 is 10~180 degrees, and preferably to be about 90 degrees for easily adjusting the phase of the sound field. In the earphone 500B of the present embodiment, any one of the signal entities provided by the 5.1 channel of the DVD player, such as the sub-speaker 580 of FIG. 5B, may be independently pulled out and disposed on the outer edge of the curve tube 584. In the earphone 500B of the present embodiment, a resonant chamber is formed outside of the earphone main body 510, and the resonant chamber is adjusted by the curve tube 584. In the whole structure, the sound wave inside the resonant chamber is transmitted to the main sound field inside the case 511 with air media through the external tube 537.

As described above, the earphone provided by the present invention comprises an external tube disposed on the case. In addition, the case and the cover of the earphone togetherly form an interior chamber, and by adjusting the space in the external tube, the spatial sound effect is improved and the phase of the sound field is further adjusted.

In the earphone mentioned above, besides both earphone 500A of FIG. 5A and earphone 500B of FIG. 5B having an external tube, an earphone having an effect of balance sound field is further provided in another embodiment of the present invention. The earphone with a balance sound effect couples any one of the sound sources provided by the 5.1 channel sound sources from the DVD player to two or more than two speakers at the same time, wherein one speaker is disposed on a speaker holder in the interior chamber and the other speaker is disposed in the external tube. With such arrangement, a sound field is formed by these two or more than two speakers, which are coupled to a same sound source, based on the difference of the sounding point and the angle or physical location of the speakers, such that the sound field formed by this sound signal is enlarged and more saturated. These two or more than two speakers may be coupled to the sound signal either in parallel or in serial. Alternatively, a different level sound field can be formed by disposing these two or more than two speakers on different locations and with different angles. For example, the sub-speaker 540A is disposed inside the case 511 of the earphone 500A, and the other sub-speaker 540B is disposed on the external tube 535 that is extended from the both side walls of the composite chamber 533.

Besides the earphone having an external tube mentioned above, an earphone having a function of dividing the sound field is further provided in an embodiment of the present invention. A tube is externally coupled to the earphone main body, and an interior chamber is formed on the outermost edge of the tube. Therefore, any one of the signal entities provided by the 5.1 channel sound sources from the DVD player may be disposed on the cover of the interior chamber with any angle and direction, so as to form a resonance in the chamber. In another embodiment of the present invention, a curve tube is further coupled on the case of the interior chamber for not creating the resonance in the chamber directly. Accordingly, the sound source on the case of the interior chamber provided by the 5.1 channel of the DVD player is pulled away from the main sound field formed by the 5.1 channel. In other words, in the earphone of the present embodiment, a resonant chamber is formed on the cover of the main body, and the sound wave inside the resonant chamber is transmitted to the main sound field inside the case with air media through the external tube.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. An earphone structure, comprising:

an earphone main body comprising a case, a cover, and a case extension unit for forming a main chamber;

a main speaker and a plurality of sub-speakers, wherein the main speaker and some of the sub-speakers are disposed inside the case; and a first external tube disposed on the earphone main body and having at least one portion extending outward beyond the earphone main body, wherein a sound field formed inside the earphone structure is further adjusted by adjusting the space in the first external tube.

2. The earphone structure of claim 1, wherein the first external tube is disposed on the case extension unit of the earphone main body.

3. The earphone structure of claim 1, wherein the first external tube is disposed on the case of the earphone main body and extended from a composite chamber inside the earphone structure.

4. The earphone structure of claim 1, wherein one of the sub-speakers is disposed on the first external tube.

5. The earphone structure of claim 1, wherein the space in the first external tube is adjusted by changing the length of the first external tube.

6. The earphone structure of claim 1, wherein the space in the first external tube is adjusted by raiding the first external tube.

7. The earphone structure of claim 1, further comprising a second external tube disposed on the earphone main body for adjusting the sound field formed inside the earphone structure.

8. The earphone structure of claim 7, wherein the second external tube is disposed on the case extension unit of the earphone main body.

9. The earphone structure of claim 7, wherein the second external tube is disposed on the case of the earphone main body.

10. The earphone structure of claim 7, wherein the way to adjust the sound field formed inside the earphone structure by adjusting the space in the second external tube is to change the length of the second external tube.

11. The earphone structure of claim 7, wherein the way to adjust the sound field formed inside the earphone structure by adjusting the space in the second external tube is to fold the second external tube.

12. The earphone structure of claim 1, wherein two of the sub-speakers are coupled to a same sound source, in which one is disposed in the earphone main body, and the other one is coupled on die first external tube outside of the earphone main body.

13. The earphone structure of claim 12, wherein the two sub-speakers are coupled to the same sound source in parallel.

14. The earphone structure of claim 12, wherein the two sub-speakers are coupled to the same sound source in serial.

15. The earphone structure of claim 1, wherein three of the sub-speakers are coupled to a same sound source, and are optionally disposed inside the earphone main body and on the first external tube externally coupled to the earphone main body.

16. The earphone structure of claim 15, wherein the three sub-speakers are coupled to the same sound source in parallel.

17. The earphone structure of claim 15, wherein the three sub-speakers are coupled to the same sound source in serial.

18. The earphone structure of claim 1, further comprising:

a second tube coupled on the earphone main body; and an interior chamber disposed on the outermost edge of the tube, wherein a resonant chamber is formed inside the interior chamber, and the sound wave in the resonant chamber is transmitted to the sound field inside the earphone main body with air media.

19. The earphone structure of claim 18, further comprising a curve tube coupled on the case of the interior chamber for adjusting the resonant chamber.

20. The earphone structure of claim 19, wherein the angle of the curve tube is 10~180 degrees.

21. The earphone structure of claim 19, wherein the angle of the curve tube is 90 degrees.

22. The earphone structure of claim 19, wherein one of the sub-speakers is disposed on the outer edge of the curve tube.

23. An earphone structure, comprising:

an earphone main body comprising a case, a cover, and a case extension unit for forming a main chamber;

a main speaker and a plurally of sub-speakers, wherein the main speaker and some of the sub-speakers are disposed inside the case; and a first external tube disposed on the earphone main body, wherein a sound field formed inside the earphone structure is further adjusted by adjusting the space in the first external tube;

wherein two of the sub-speakers are coupled to a same sound source, in which one in disposed In the earphone main body, and the other one is coupled on the first external tube outside of the earphone main body.

24. The earphone structure of claim 23, wherein the two sub-speakers are coupled to the same sound source in parallel.

25. The earphone structure of claim 24, wherein the two sub-speakers are coupled to the same sound source in serial.

* * * * *